US009267387B2

(12) United States Patent
Farineau et al.

(10) Patent No.: US 9,267,387 B2
(45) Date of Patent: Feb. 23, 2016

(54) SEAL PLATFORM

(71) Applicant: General Electric Company, Schenectady, NY (US)

(72) Inventors: Thomas Joseph Farineau, Schoharie, NY (US); Michael Dennis Mack, Ballston Spa, NY (US); Timothy Scott McMurray, Fultonville, NY (US); Xiaoqing Zhen, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 464 days.

(21) Appl. No.: 13/941,758

(22) Filed: Jul. 15, 2013

(65) Prior Publication Data

US 2015/0016959 A1 Jan. 15, 2015

(51) Int. Cl.

| | |
|---|---|
| ***F01D 11/02*** | (2006.01) |
| ***F01D 11/00*** | (2006.01) |
| ***F01D 11/08*** | (2006.01) |

(52) U.S. Cl.

CPC ..... *F01D 11/02* (2013.01); *F01D 11/001* (2013.01); *F01D 11/08* (2013.01); *F05D 2240/56* (2013.01); *F05D 2260/30* (2013.01)

(58) Field of Classification Search

CPC ..... F01D 11/001; F01D 11/02; F01D 11/08; F05D 2240/55; F05D 2240/56; F05D 2260/30; F05D 2260/31

See application file for complete search history.

(56) References Cited

U.S. PATENT DOCUMENTS

| | | | | |
|---|---|---|---|---|
| 3,941,500 | A | 3/1976 | Glenn | |
| 4,820,119 | A | 4/1989 | Joyce | |
| 5,501,573 | A * | 3/1996 | Sanders | F01D 5/225 277/303 |
| 6,220,814 | B1 | 4/2001 | Brushwood et al. | |
| 7,494,317 | B2 * | 2/2009 | Keller | F01D 11/025 415/135 |
| 8,177,495 | B2 | 5/2012 | Bowes et al. | |
| 8,708,641 | B2 * | 4/2014 | Ueda | F01D 5/16 415/1 |
| 2011/0164962 | A1 | 7/2011 | Wilson, Jr. et al. | |
| 2012/0251303 | A1 | 10/2012 | Zheng et al. | |
| 2012/0288361 | A1 | 11/2012 | Lu et al. | |

FOREIGN PATENT DOCUMENTS

| | | | |
|---|---|---|---|
| EP | 0639735 | A1 | 2/1995 |

* cited by examiner

*Primary Examiner* — Richard Edgar
*Assistant Examiner* — Juan G Flores
(74) *Attorney, Agent, or Firm* — Ernest G. Cusick; Hoffman Warnick LLC

(57) ABSTRACT

A partial seal platform for mounting a seal and securing seal to a rotor or a casing including a first arcuate securing segment with a first securing notch for receiving a first securing ridge of rotor or casing; a second arcuate securing segment with a second securing notch for receiving a second securing ridge of rotor or casing; an arcuate coupling segment with a first flat ridge forming a first and second lateral notch on each side of the first flat ridge for receiving the first arcuate securing segment and the second arcuate securing segment; and an arcuate mounting segment including a second flat ridge forming a lateral notch on each side of second flat ridge for receiving first arcuate securing segment and second arcuate securing segment.

20 Claims, 7 Drawing Sheets

SEAL PLATFORM

FIELD OF THE INVENTION

This invention relates generally to turbines and more particularly to a seal platform for a turbine.

BACKGROUND OF THE INVENTION

In a steam or gas turbine, seals may be attached to a rotor or a casing. A seal on the rotor provides a seal between the rotor and the nozzles. A seal on the casing provides a seal between the casing and the buckets. A variety of seals, for example, seal teeth or seal brushes, are well known in the art. The relative ease or difficulty in assembling a turbine, disassembling a turbine, and packing (the overall configuration of parts) a turbine are all considerations in turbine and turbine component design.

BRIEF DESCRIPTION OF THE INVENTION

A first aspect of the invention provides a partial seal platform for mounting a seal and securing the seal to one of a rotor or a casing, comprising: a first arcuate securing segment including a first securing notch for receiving a first securing ridge of the rotor or the casing; a second arcuate securing segment including a second securing notch for receiving a second securing ridge of the rotor or the casing; an arcuate coupling segment including a first flat ridge forming a first and second lateral notch on each side of the first flat ridge for receiving the first arcuate securing segment and the second arcuate securing segment, wherein the first securing notch and the second securing notch open away from each other, and wherein the arcuate coupling segment has at least one passage in the first flat ridge for receiving a part of a coupling bolt; an arcuate mounting segment including a second flat ridge forming a lateral notch on each side of the second flat ridge for receiving the first arcuate securing segment and the second arcuate securing segment, wherein the arcuate mounting segment has at least one passage in the second flat ridge for receiving a part of the coupling bolt, and wherein the second flat ridge aligns with the first flat ridge.

A second aspect of the invention provides a seal platform for mounting a seal and securing the seal to one of a rotor or a casing, comprising: at least two first arcuate securing segments each first arcuate securing segment including a first securing notch for receiving a first securing ridge of the rotor or the casing, wherein the at least two first arcuate securing segments are aligned end-to-end to form a first securing ring; at least two second arcuate securing segments each second arcuate securing segment including a second securing notch for receiving a second securing ridge of the rotor or the casing, wherein the at least two second arcuate securing segments are aligned end-to-end to form a second securing ring; at least two arcuate coupling segments each arcuate coupling segment including a first flat ridge forming a first and second lateral notch on each side of the first flat ridge for receiving one of the first arcuate securing segments and one of the second arcuate securing segments, wherein the first securing notch and the second securing notch open away from each other, wherein each arcuate coupling segment has at least one passage in the first flat ridge for receiving a part of a coupling bolt, and wherein the at least two arcuate coupling segments are aligned end-to-end to form a coupling ring; at least two arcuate mounting segments each arcuate mounting segment including a second flat ridge forming a lateral notch on each side of the second flat ridge for receiving one of the first arcuate securing segments and one of the second arcuate securing segments, wherein each arcuate mounting segment has at least one passage in the second flat ridge for receiving a part of the coupling bolt, and wherein the second flat ridge aligns with the first flat ridge, and wherein the at least two arcuate mounting segments are aligned end-to-end to form a mounting ring.

A third aspect of the invention provides a rotor or a casing of a turbine, comprising: at least one seal platform for a nozzle or a bucket including: at least two first arcuate securing segments each first arcuate securing segment including a first securing notch for receiving a first securing ridge of the rotor or the casing, wherein the at least two first arcuate securing segments are aligned end-to-end to form a first securing ring; at least two second arcuate securing segments each second arcuate securing segment including a second securing notch for receiving a second securing ridge of the rotor or the casing, wherein the at least two second arcuate securing segments are aligned end-to-end to form a second securing ring; at least two arcuate coupling segments each arcuate coupling segment including a first flat ridge forming a first and second lateral notch on each side of the first flat ridge for receiving one of the first arcuate securing segments and one of the second arcuate securing segments, wherein the first securing notch and the second securing notch open away from each other, wherein each arcuate coupling segment has at least one passage in the first flat ridge for receiving a part of a coupling bolt, and wherein the at least two arcuate coupling segments are aligned end-to-end to form a coupling ring; at least two arcuate mounting segments each arcuate mounting segment including a second flat ridge forming a lateral notch on each side of the second flat ridge for receiving one of the first arcuate securing segments and one of the second arcuate securing segments, wherein each arcuate mounting segment has at least one passage in the second flat ridge for receiving a part of the coupling bolt, and wherein the second flat ridge aligns with the first flat ridge, and wherein the at least two arcuate mounting segments are aligned end-to-end to form a mounting ring.

These and other aspects, advantages and salient features of the invention will become apparent from the following detailed description, which, when taken in conjunction with the annexed drawings, where like parts are designated by like reference characters throughout the drawings, disclose embodiments of the invention.

BRIEF DESCRIPTION OF THE DRAWINGS

The above and other aspects, features and advantages of the invention will be better understood by reading the following more particular description of the invention in conjunction with the accompanying drawings.

Figure 1:
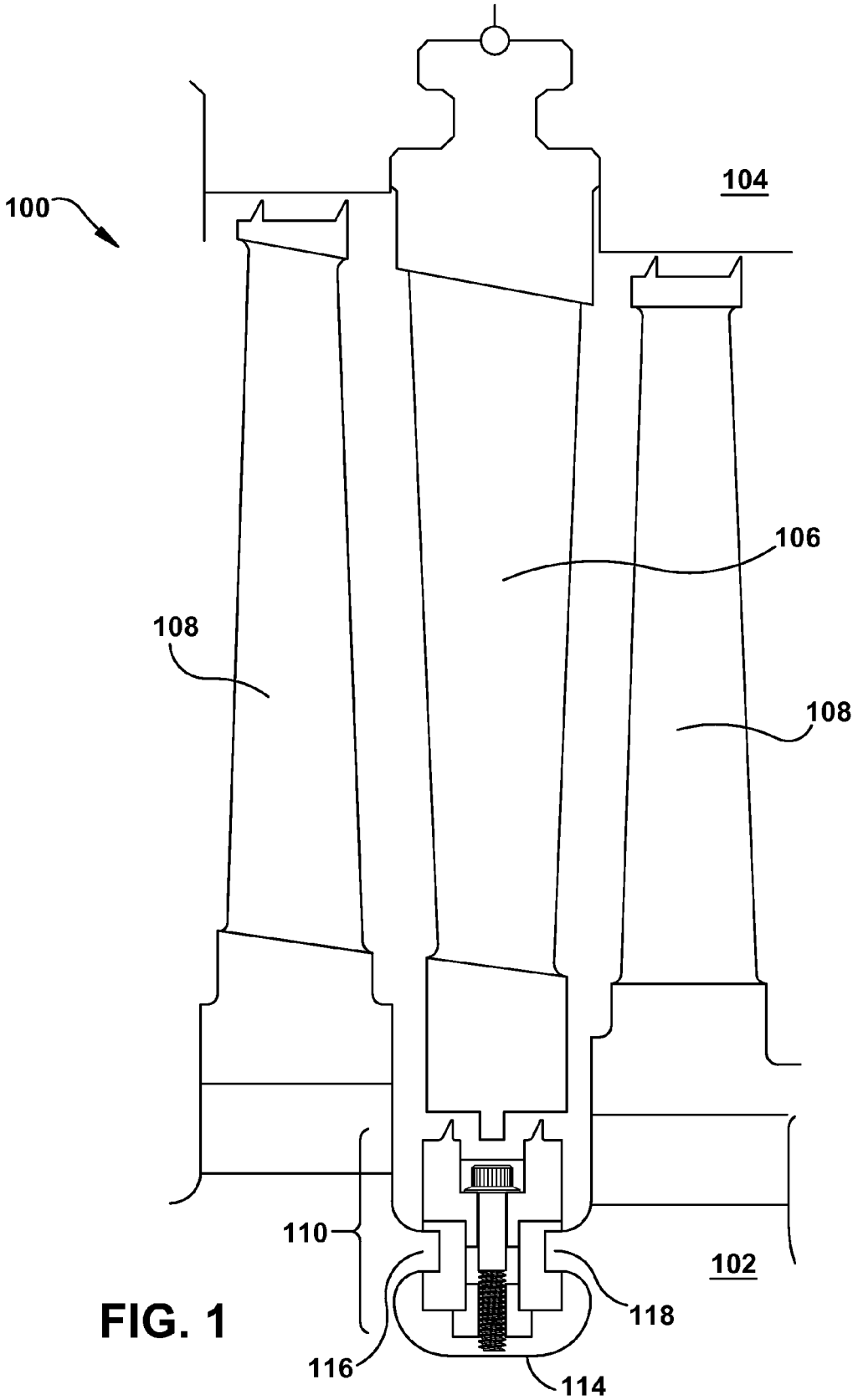
FIG. 1 shows a cross-sectional view of a portion of a turbine and one embodiment of at least one seal platform.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION OF THE INVENTION

Figure 2:
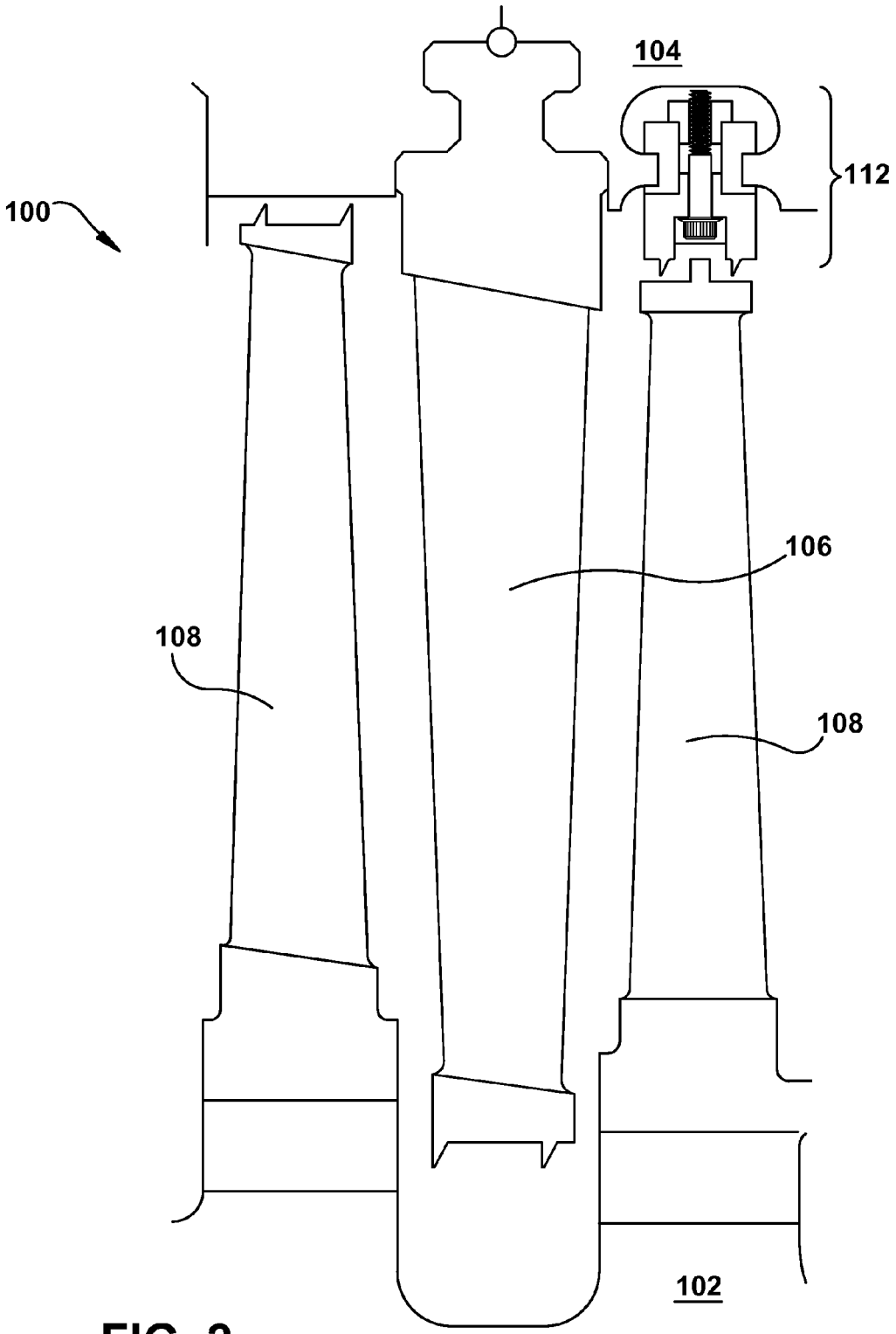
FIG. 2 shows a cross-sectional view of a portion of a turbine and one embodiment of at least one seal platform.

Referring to the drawings, FIGS. 1 and 2 show cross-sectional views of a portion of a turbine 100 seal platforms according to one embodiment of the invention. Turbine 100 may include a gas turbine or a steam turbine. As shown in FIGS. 1 and 2, turbine 100 includes a rotor 102, a casing 104, a nozzle 106, at least two buckets 108, and at least two seal platforms 110, 112. FIG. 1 shows a segmented seal platform 110 connected to the rotor 102. FIG. 2 shows a seal platform 112 connected to the casing 104. The rotor 102 is configured to couple with seal platform 110. The casing 104 is configured to couple with seal platform 112. The rotor 102 or the casing 104 may include at least one seal platform channel 114. At least one seal platform channel 114 may include a first securing ridge 116 and a second securing ridge 118 for securing seal platform 110, 112 to the rotor 102 or the casing 104.

Figure 3:
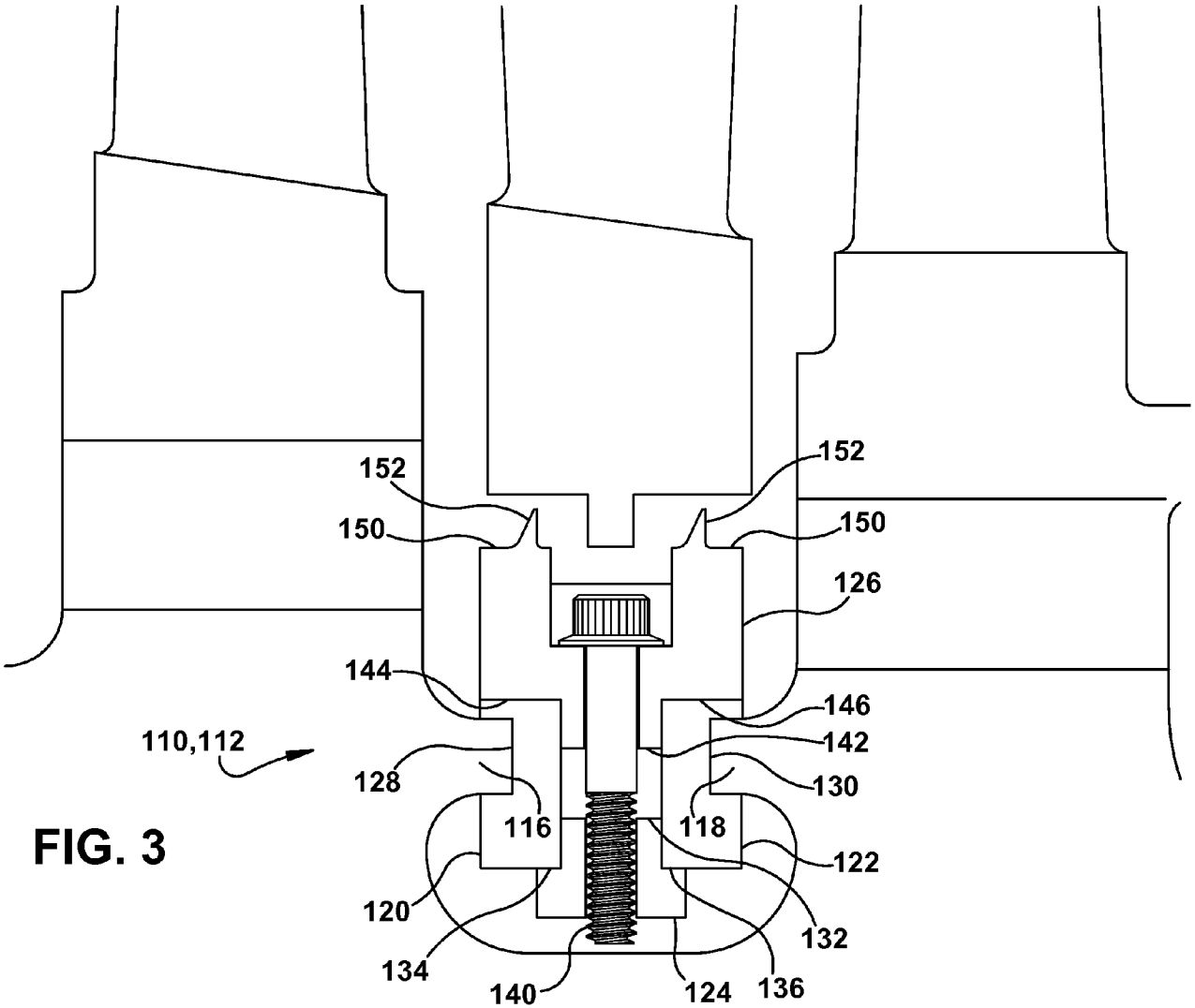
FIG. 3 shows a cross-sectional view of one embodiment of the seal platform.
Figure 4:
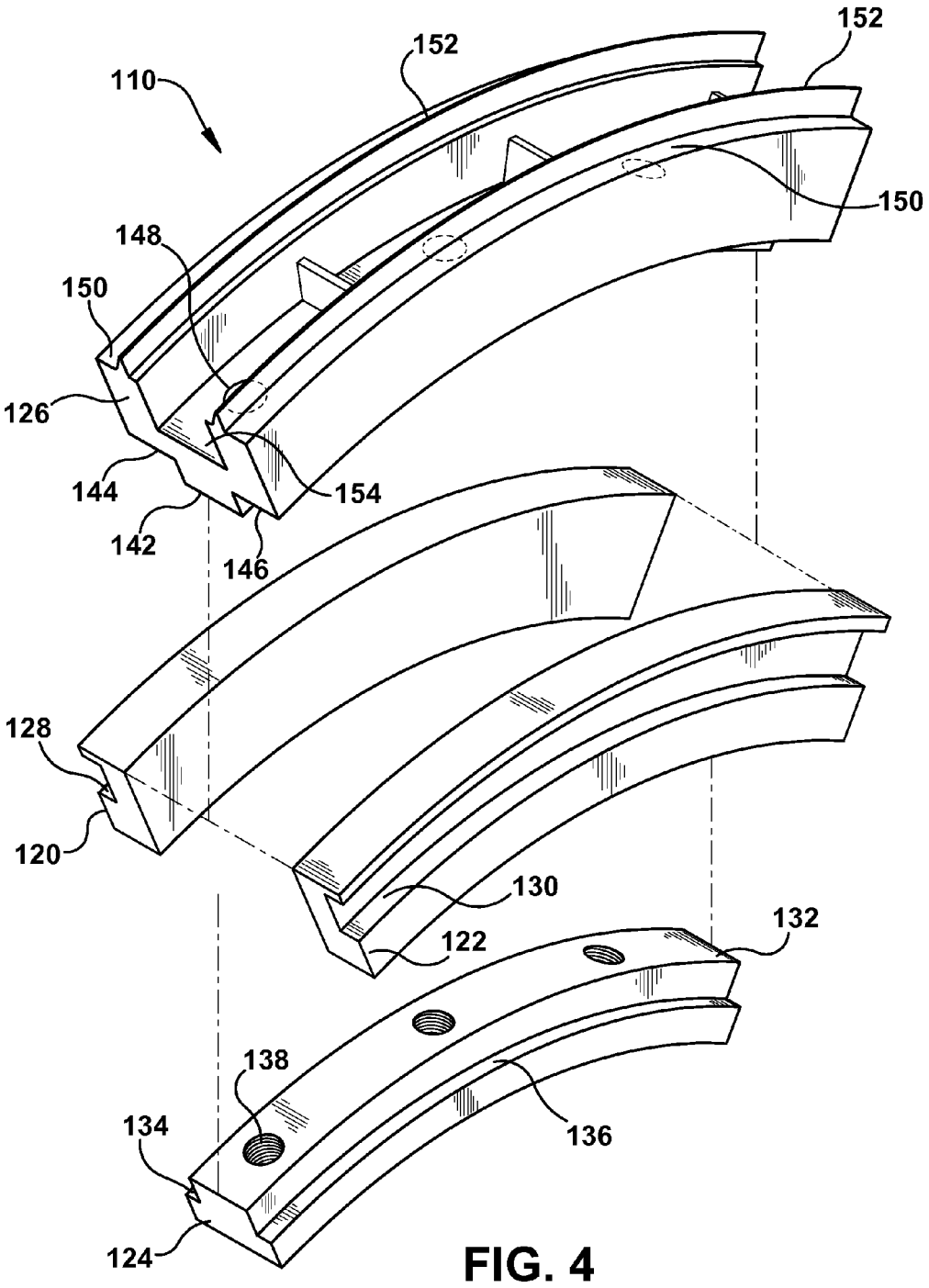
FIG. 4 shows a perspective view of one embodiment of one convex arc of the seal platform adapted for the rotor.
Figure 5:
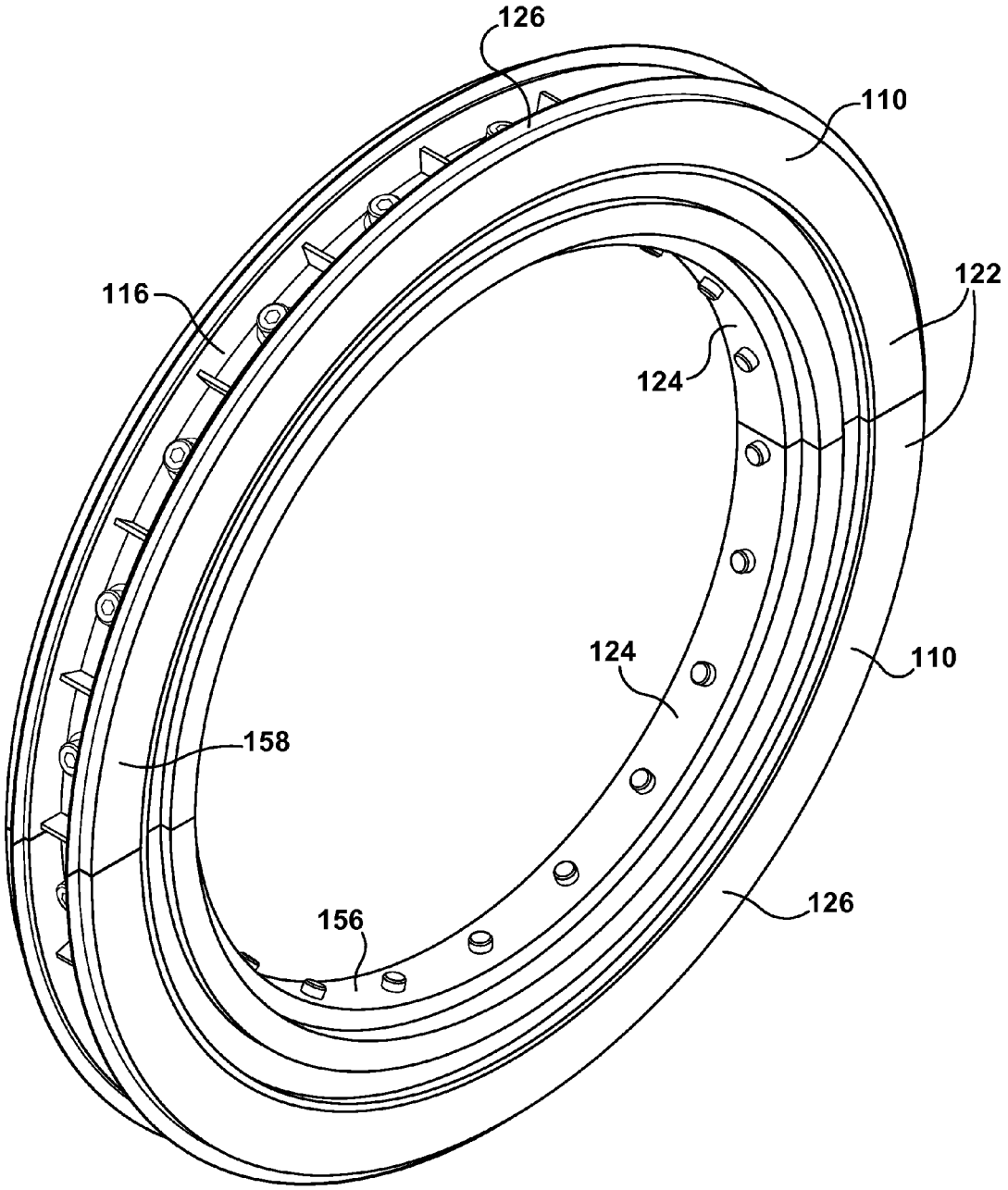
FIG. 5 shows a perspective view of one embodiment of the seal platform adapted for the rotor.

FIG. 3 shows a cross-sectional view of one embodiment of the seal platform 110, 112. FIG. 4 shows a perspective view of one embodiment of one convex arc of the seal platform 110 adapted for the rotor 102. FIG. 5 shows a perspective view of one embodiment of the seal platform 110 adapted for the rotor 102. Seal platform may include a first arcuate securing segment 120, a second arcuate securing segment 122, an arcuate coupling segment 124, and an arcuate mounting segment 126. The first arcuate securing segment 120 may include a first securing notch 128 for receiving the first securing ridge 116 (FIG. 3) of the rotor 102 or the casing 104. The second arcuate securing segment 122 may include a second securing notch 130 for receiving the second securing ridge 118 (FIG. 3) of the rotor 102 or the casing 104. The arcuate coupling segment 122 may include a first flat ridge 132 forming a first and second lateral notch 134, 136 on each side of the first flat ridge 132 for receiving the first arcuate securing segment 120 and the second arcuate securing segment 122. The first securing notch 128 and the second securing notch 130 may open away from each other. The arcuate coupling segment 122 may include a first passage 138 in the first flat ridge 132 for receiving a part of a coupling bolt 140. The arcuate mounting segment 126 may include a second flat ridge 142 forming a first and a second lateral notch 144, 146 on each side of the second flat ridge 142 for receiving the first arcuate securing segment 120 and the second arcuate securing segment 122, respectively. The arcuate mounting segment 126 may include a second passage 148 extending through to the second flat ridge 142 for receiving a part of the coupling bolt 140. The second flat ridge 142 may align with the first flat ridge 132 to receive the coupling bolt 140 through the first passage 148 and the second passage 138.

As shown in FIG. 4, a mounting surface 150 of the arcuate mounting segment 126 supports a pair of seals 152. The seals 152 may include a seal tooth, a seal brush, or any combination of seal teeth or seal brushes. A person skilled in the art will readily recognize that any known seal tooth or seal brush may be included on the mounting surface 150. The arcuate mounting segment 126 may include a recessed ridge 154. The recessed ridge 154 may include the at least one second passage 148 for receiving the part of the coupling bolt 140.

Still referring to FIG. 4, each segment of the seal platform 110 has an arc no greater than 180 degrees. Referring to FIG. 5, two segments of the seal platform 110 collectively form an approximately 360 degree arc. Each segment of seal platform 110 is convex relative to the rotor. In FIG. 5, the at least two first arcuate securing segments 120 (not shown in FIG. 5) may be aligned end-to-end to form a first securing ring (not shown in FIG. 5); the at least two second arcuate securing segments 122 may be aligned end-to-end to form a second securing ring 156; the at least two arcuate coupling segments 124 may be aligned end-to-end to form a coupling ring 158; and the at least two arcuate mounting segments 126 may be aligned end-to-end to form a mounting ring 160. Accordingly, seal platform 110 may include more than two segments, providing that the more than two segments of the seal platform 110 collectively form an approximately 360 degree arc and that no segment forms an arc greater than 180 degrees.

Figure 6:
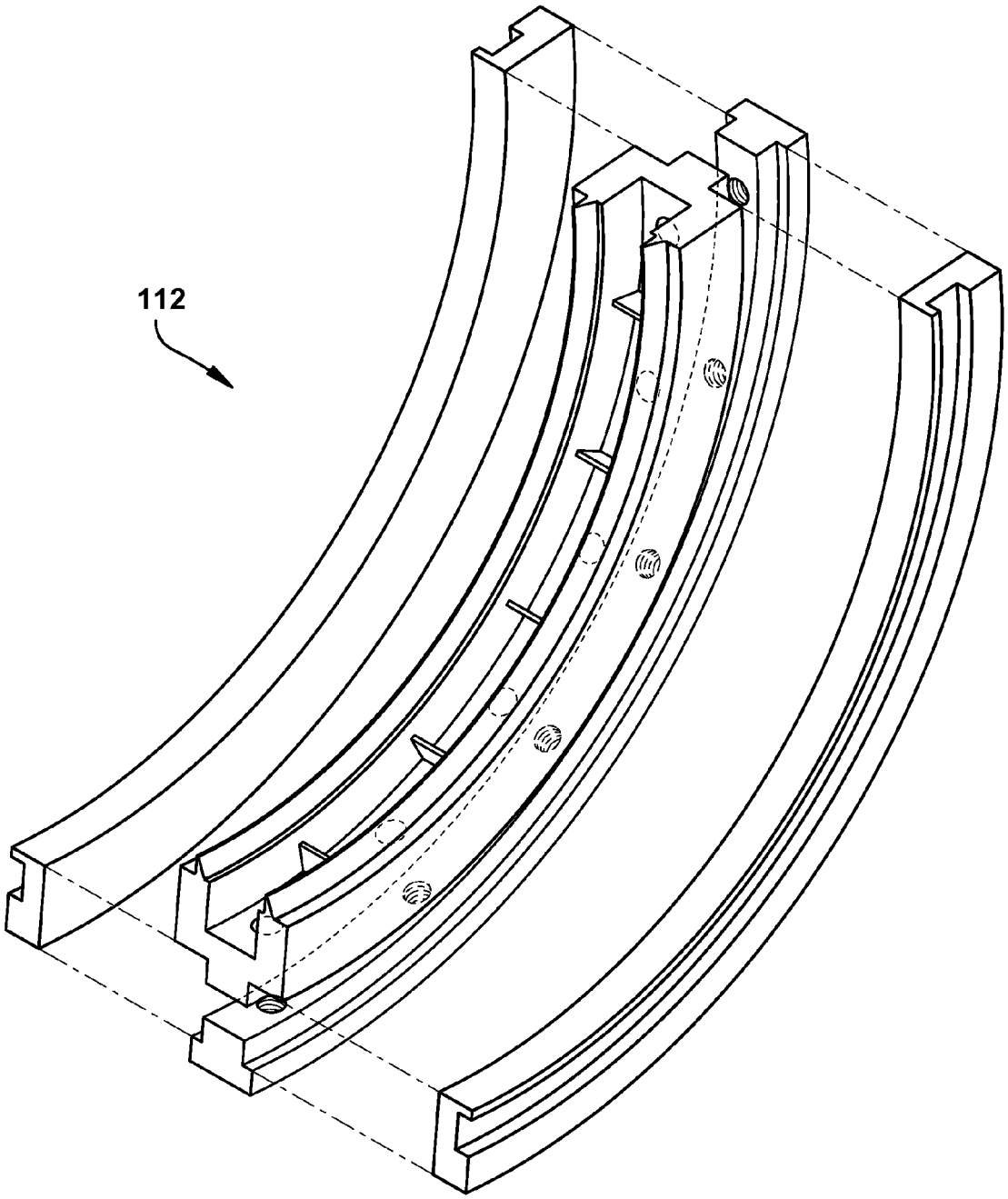
FIG. 6 shows a perspective view of one embodiment of one concave arc of the seal platform adapted for the casing.
Figure 7:
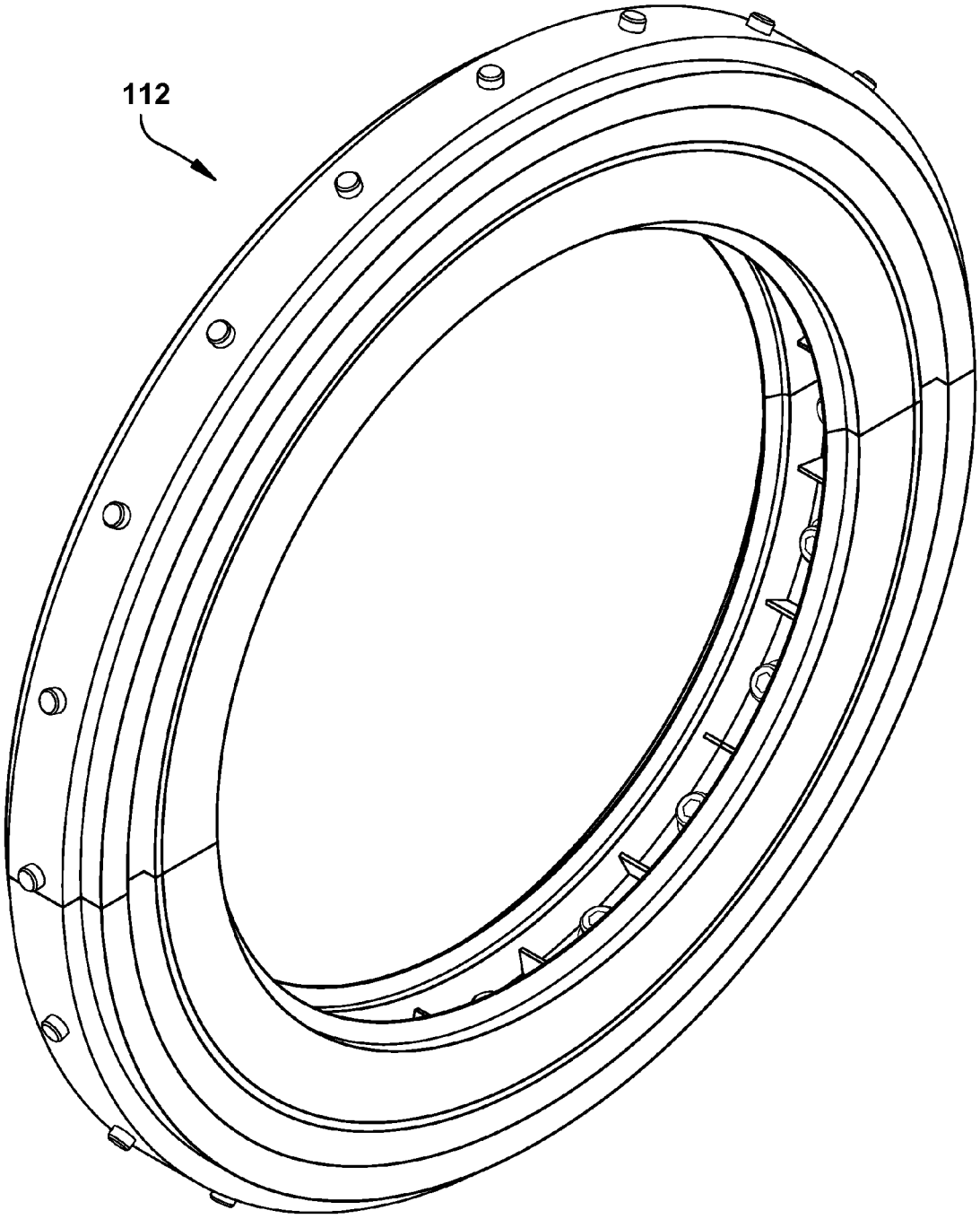
FIG. 7 shows a perspective view of one embodiment of the seal platform adapted for the casing.

FIG. 6 shows a perspective view of one embodiment of one segment of the seal platform 112 adapted for the casing 104 (FIG. 2). FIG. 7 shows a perspective view of one embodiment of the seal platform 112 adapted for the casing 104 (FIG. 2). Seal platform 112 is identical to seal platform 110 (FIG. 5) with the exception that seal platform 112 arcs concavely relative to the casing 104 (FIG. 2).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof Therefore, it is intended that the invention not be limited to the particular embodiment disclosed as the best mode contemplated for carrying out this invention, but that the invention will include all embodiments falling within the scope of the appended claims.

What is claimed is:

1. A partial seal platform for mounting a seal and securing the seal to one of a rotor or a casing, comprising:

a first arcuate securing segment including a first securing notch for receiving a first securing ridge of the rotor or the casing;

a second arcuate securing segment including a second securing notch for receiving a second securing ridge of the rotor or the casing;

an arcuate coupling segment including a first flat ridge forming a first and second lateral notch on each side of the first flat ridge for receiving the first arcuate securing segment and the second arcuate securing segment, wherein the first securing notch and the second securing notch open away from each other, and wherein the arcuate coupling segment has at least one passage in the first flat ridge for receiving a part of a coupling bolt;

an arcuate mounting segment including a second flat ridge forming a lateral notch on each side of the second flat ridge for receiving the first arcuate securing segment and the second arcuate securing segment, wherein the arcuate mounting segment has at least one passage in the second flat ridge for receiving a part of the coupling bolt, and wherein the second flat ridge aligns with the first flat ridge.

2. The device of claim 1, wherein a mounting surface of the arcuate mounting segment supports at least one seal.

3. The device of claim 2, wherein the at least one seal includes one of a seal tooth or a seal brush.

4. The device of claim 1, wherein the arcuate mounting segment includes a recessed ridge.

5. The device of claim 1, wherein the rotor or the casing are configured to be coupled to a gas turbine or a steam turbine.

6. The device of claim 1, wherein the partial seal platform arcs convexly relative to the rotor.

7. The device of claim 1, wherein the partial seal platform arcs concavely relative to the casing.

8. A seal platform for mounting a seal and securing the seal to one of a rotor or a casing, comprising:

at least two first arcuate securing segments each first arcuate securing segment including a first securing notch for receiving a first securing ridge of the rotor or the casing, wherein the at least two first arcuate securing segments are aligned end-to-end to form a first securing ring;

at least two second arcuate securing segments each second arcuate securing segment including a second securing notch for receiving a second securing ridge of the rotor or the casing, wherein the at least two second arcuate securing segments are aligned end-to-end to form a second securing ring;

at least two arcuate coupling segments each arcuate coupling segment including a first flat ridge forming a first and second lateral notch on each side of the first flat ridge for receiving one of the first arcuate securing segments and one of the second arcuate securing segments, wherein the first securing notch and the second securing notch open away from each other, wherein each arcuate coupling segment has at least one passage in the first flat ridge for receiving a part of a coupling bolt, and wherein the at least two arcuate coupling segments are aligned end-to-end to form a coupling ring;

at least two arcuate mounting segments each arcuate mounting segment including a second flat ridge forming a lateral notch on each side of the second flat ridge for receiving one of the first arcuate securing segments and one of the second arcuate securing segments, wherein each arcuate mounting segment has at least one passage in the second flat ridge for receiving a part of the coupling bolt, and wherein the second flat ridge aligns with the first flat ridge, and wherein the at least two arcuate mounting segments are aligned end-to-end to form a mounting ring.

9. The device of claim 8, wherein a mounting surface of each arcuate mounting segment supports at least one seal.

10. The device of claim 9, wherein the at least one seal includes one of a seal tooth or a seal brush.

11. The device of claim 8, wherein each arcuate mounting segment includes a recessed ridge.

12. The device of claim 8, wherein the rotor or the casing are configured to be coupled to a gas turbine or a steam turbine.

13. The device of claim 8, wherein seal platform arcs convexly relative to the rotor.

14. The device of claim 8, wherein seal platform arcs concavely relative to the casing.

15. A rotor or a casing of a turbine, comprising:

at least one seal platform for a nozzle or a bucket including:

at least two first arcuate securing segments each first arcuate securing segment including a first securing notch for receiving a first securing ridge of the rotor or the casing, wherein the at least two first arcuate securing segments are aligned end-to-end to form a first securing ring;

at least two second arcuate securing segments each second arcuate securing segment including a second securing notch for receiving a second securing ridge of the rotor or the casing, wherein the at least two second arcuate securing segments are aligned end-to-end to form a second securing ring;

at least two arcuate coupling segments each arcuate coupling segment including a first flat ridge forming a first and second lateral notch on each side of the first flat ridge for receiving one of the first arcuate securing segments and one of the second arcuate securing segments, wherein the first securing notch and the second securing notch open away from each other, wherein each arcuate coupling segment has at least one passage in the first flat ridge for receiving a part of a coupling bolt, and wherein the at least two arcuate coupling segments are aligned end-to-end to form a coupling ring;

at least two arcuate mounting segments each arcuate mounting segment including a second flat ridge forming a lateral notch on each side of the second flat ridge for receiving one of the first arcuate securing segments and one of the second arcuate securing segments, wherein each arcuate mounting segment has at least one passage in the second flat ridge for receiving a part of the coupling bolt, and wherein the second flat ridge aligns with the first flat ridge, and wherein the at least two arcuate mounting segments are aligned end-to-end to form a mounting ring.

16. The device of claim 15, wherein a mounting surface of each arcuate mounting segment supports at least one seal.

17. The device of claim 16, wherein the at least one seal includes one of a seal tooth or a seal brush.

18. The device of claim 15, wherein each arcuate mounting segment includes a recessed ridge.

19. The device of claim 15, wherein seal platform arcs convexly relative to the rotor.

20. The device of claim 15, wherein seal platform arcs concavely relative to the casing.

* * * * *